US005575464A

United States Patent [19]

Martinez et al.

[11] Patent Number: 5,575,464

[45] Date of Patent: Nov. 19, 1996

[54] URGE ROLLER FOR REGISTERING BOTTOM EDGES OF FLAT ARTICLES IN A STACKER

[75] Inventors: Miguel O. Martinez, Danbury, Conn.; James W. Murphy, Midlothian, Va.

[73] Assignee: Pitney Bowes Inc., Stamford, Conn.

[21] Appl. No.: 572,428

[22] Filed: Dec. 14, 1995

[51] Int. Cl.[6] ..... B65H 29/22

[52] U.S. Cl. ..... 271/2; 271/178; 271/179; 271/181

[58] Field of Search ..... 271/2, 178, 179, 271/181; 414/798.5

[56] References Cited

U.S. PATENT DOCUMENTS

| | | | |
|---|---|---|---|
| 3,166,313 | 1/1965 | Rehm | 271/178 |
| 4,019,730 | 4/1977 | Staudinger et al. | 271/181 |
| 4,509,739 | 4/1985 | Kurokawa | 271/179 X |
| 4,657,241 | 4/1987 | Frank | 271/305 |
| 5,186,452 | 2/1993 | Holbrook | 271/216 |
| 5,201,504 | 4/1993 | Fallos et al. | 271/2 |
| 5,224,697 | 7/1993 | Darchis et al. | 271/201 |
| 5,233,814 | 8/1993 | Bergerioux et al. | 53/536 |
| 5,417,414 | 5/1995 | Belec et al. | 271/178 |
| 5,449,159 | 9/1995 | Belec et al. | 271/178 X |

OTHER PUBLICATIONS

Ribbed Roller for Document Stacking, IBM Technical Disclosure Bulletin, vol. 22, No. 4, Sep. 1979.

*Primary Examiner*—Karen B. Merritt
*Assistant Examiner*—Janice L. Krizek
*Attorney, Agent, or Firm*—Angelo N. Chaclas; Charles R. Malandra, Jr.; Melvin J. Scolnick

[57] ABSTRACT

An improvement in a stacking system having an urge roller, an input guide, a spring loaded backup paddle, a substantially horizontal surface and a substantially vertical registration wall. The improvement comprising a rib wrapped around the surface of the urge roller in a helical pattern. Thus, as the urge roller rotates and feeds an article toward the vertical registration wall, the helical rib forces the bottom edge of the article into contact with the horizontal surface. As a result, a properly aligned and tight stack of articles is formed.

5 Claims, 5 Drawing Sheets

URGE ROLLER FOR REGISTERING BOTTOM EDGES OF FLAT ARTICLES IN A STACKER

FIELD OF THE INVENTION

This invention relates generally to apparatus for stacking flat articles. More particularly, this invention is directed to apparatus for on-edge stacking of envelopes

BACKGROUND OF THE INVENTION

Conventional "on-edge" mail stacking systems are usually composed of a transport followed by various forms of stacking mechanisms. Generally, multi-bin on-edge stacking systems include gating mechanisms which divert specific envelopes into predetermined stacker bins. Such on-edge stacking systems are well known. The overwhelming majority of these systems stack envelopes received in a vertical orientation on a horizontal surface commonly referred to as a stacker deck.

Typically, in an on-edge stacking system envelopes are transported vertically along a dual belt transport system, deflected into a stacker bin by a deflector mechanism, and guided into the bin by conventional guide and urging components. The conventional guides are generally flat surfaces that are made of low abrasive material so as not to interfere with the envelope being urged to the registration surface. The envelopes always stop against some sort of vertical registration surface. The integrity of the on-edge stacking is facilitated by a flat surface, commonly referred to as a paddle, that is orthogonal to the registration surface and is generally spring loaded or biased to maintain a tight stacking of the envelopes against the guide component.

The objective of mail stacking systems is to produce a tight bundle of envelopes where the bottom edge of the envelopes are resting on the horizontal surface and a lead edge of the envelopes are aligned against the vertical registration surface. This arrangement produces a stack of envelopes where the corners of each envelope formed by the bottom edge and the lead edge are perfectly aligned in two directions forming a neat stack of envelopes.

Although such systems have proved to be generally suitable for stacking most envelope types of envelopes, a problem has been recognized that the bottom edges of some types of envelopes do not properly come to rest on the horizontal surfaces. Most typically, this problem has been observed with respect to large envelopes. However, other types of envelopes are also susceptible to this problem. This problem is generally due to the normal force applied to the stack by the paddle which compresses the stack against the guides. The normal force must be large enough to produce a tight stack and yet small enough to allow an envelope fed into the stacker bin to reach the vertical surface and accordingly displace the paddle. In some instances, although the lead edge of the envelope does reach the vertical surface, the envelope becomes pinched too tightly between the rest of the stack and the guide and therefore the bottom edge does not come to rest on the horizontal surface. Thus, this envelope sticks up from the stack. At a minimum, this results in an uneven stacking of the envelopes that requires special attention of an operator. Even worse than the uneven stacking is that a jam may occur in the stacking bin.

Feed speed, ambient humidity levels, envelope size, envelope weight, envelope surface coefficient of friction and paddle spring force are some of the factors which influence whether or not the envelopes will stack tightly and properly registered along the vertical and horizontal surfaces. It is thus apparent that to compensate for these factors by manually adjusting the stacker system would require extensive trial and error. Thus, there is a need for an improved stacker system that automatically compensates for differences in these factors and produces a properly aligned and tight stack of envelopes under a wide range of operating conditions.

It is an object of the present invention to provide an improvement to the stacker system that substantially alleviates the aforementioned problem.

SUMMARY OF THE INVENTION

The present invention provides an improvement in a stacking system having an urge roller, an input guide, a spring loaded backup paddle, a substantially horizontal surface and a substantially vertical registration wall. The improvement comprising a rib wrapped around the surface of the urge roller in a helical pattern. Thus, as the urge roller rotates and feeds an envelope toward the vertical registration wall, the helical rib forces the bottom edge of the envelope into contact with the horizontal surface. As a result, a properly aligned and tight stack of envelopes is formed.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention. As shown throughout the drawings, like reference numerals designate like or corresponding parts.

DETAILED DESCRIPTION OF THE PREFERRED EMBODIMENT

Figure 1:
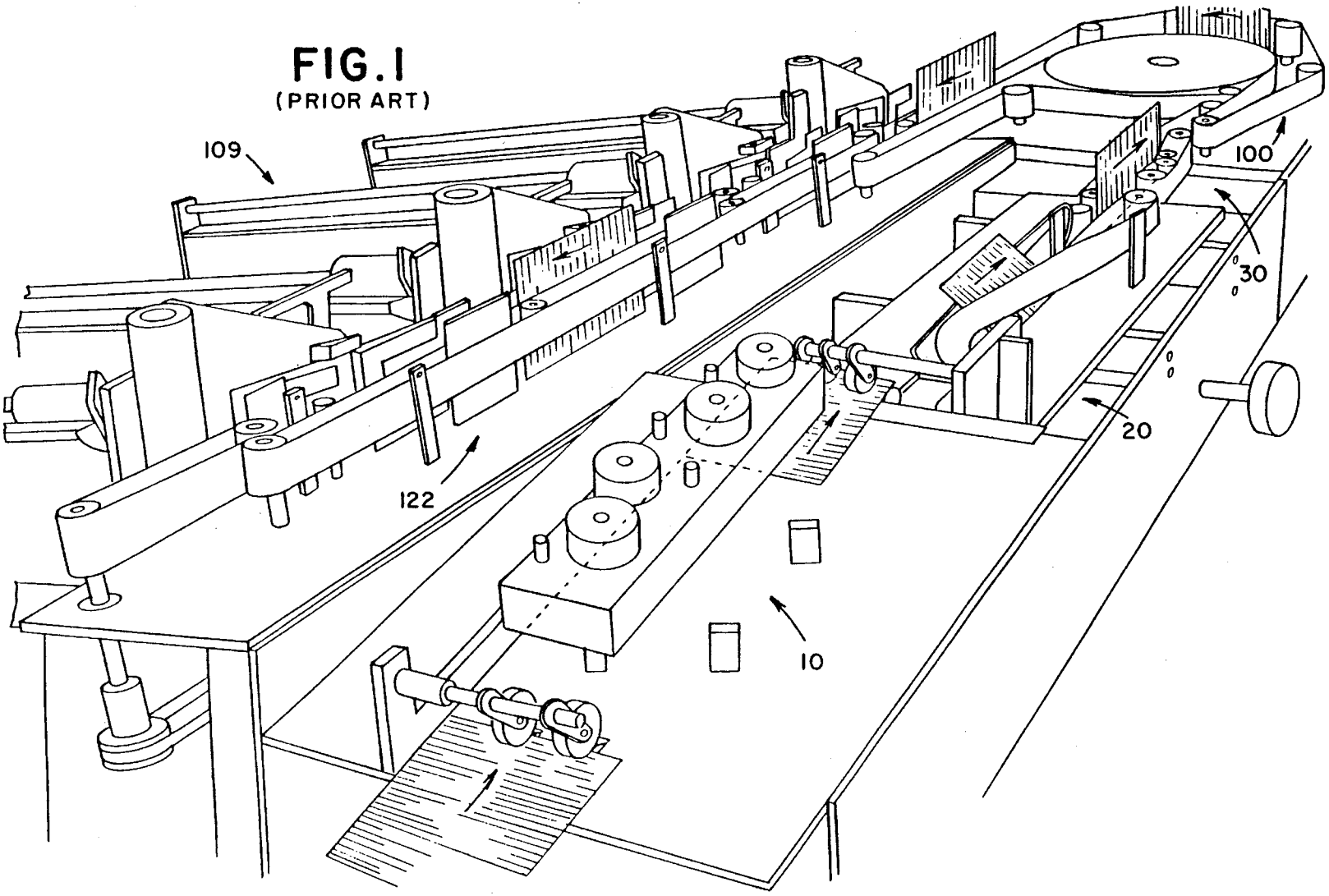
FIG. 1 (PRIOR ART)
FIG. 1 is a perspective view of a prior art apparatus including a stacking system in which the present invention may be incorporated.

In describing the present invention, reference is made to the drawings, wherein there is seen in FIG. 1 a prior art apparatus in which the present invention may be incorporated. The apparatus includes a series of modules that are connected to perform on-edge stacking or traying of envelopes assembled in an inserter or other mail finishing apparatus. An example of such an apparatus is the INTELLIGENT STACKER TRAYER readily available from Pitney Bowes Inc. of Stamford, Conn.

A top-edge alignment module 10 is connected to the output end of the inserter system (not shown). Module 10 receives envelopes from the inserter in a horizontal orientation, maintains top-edge registration of the envelopes and delivers the envelopes to a turn-up and alignment module 20 which is coupled to the output end of alignment module 10. Module 20 is adjustably positioned to achieve bottom-edge registration of the envelopes while turning the envelopes ninety degrees to a vertical orientation. Coupled to the output end of module 20 is a transport module 30 which feeds the envelopes to a drum transport module 100. Module 100 feeds the envelopes along a U-shaped path to a stacker module 109. A more detailed description of modules 10, 20, 30 and 100 is provided in U.S. patent applications Ser. Nos.: 08/152,787, now U.S. Pat. No. 5,419,440, entitled INTELLIGENT TRAYER FOR INSERTER SYSTEMS, 08/152,802, now U.S. Pat. No. 5,368,287, entitled NINETY DEGREE TURN UP APPARATUS and 08/152,793 , now U.S. Pat. No. 5,411,250, entitled TURN UP AND ALIGNMENT APPARATUS, concurrently filed on Nov. 15, 1993, assigned to the assignee of the present invention and hereby incorporated by reference.

Figure 2:
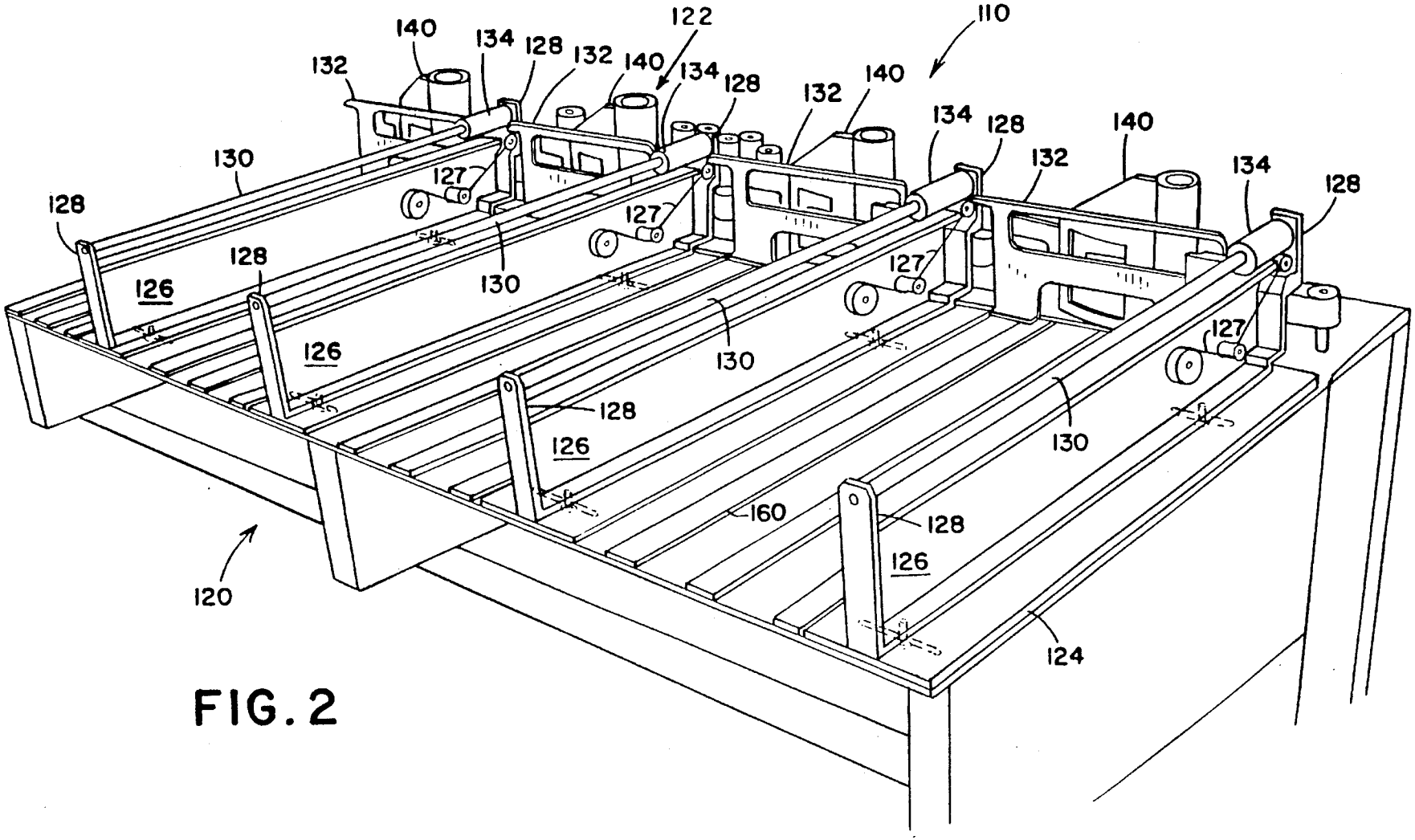
FIG. 2 is a perspective view of the stacking system in accordance with the present invention.

Referring to FIG. 2, stacker module 110 incorporating the present invention is shown. The stacker module 110 includes a plurality of bins, generally designated 120, and a vertical transport, generally designated 122. Bins 120 include a base plate 124 and a plurality of registration walls 126 that are mounted to a deck or base plate 124. Registration walls 126 divide base plate 124 into separate bin sections. In the preferred embodiment of the present invention, four registration walls 126 are mounted at certain intervals along base plate 124 to make four separate bins. Thus, the base plate 124 provides a substantially horizontal surface against which the bottom edge of the envelopes is to rest while the registration walls 126 provide a substantially vertical surface against which the lead edge of the envelopes is to align against. Typically, the base plate 124 is positioned at a slight declining angle to facilitate operator removal of a stack of envelopes from the bins 120. Each of registration walls 126 include a pair of end members 128 having a section thereof extending above the top of registration wall 126. Each registration wall 126 has a bar 130 that longitudinally extends above the top of the wall and is mounted to the pair of end members 128. A paddle 132 is slidably mounted on each of bars 130. Paddle 132 includes at one end a cylinder-shaped member 134 that is orthogonal to the flat section 136 of paddle 132. Cylinder member 134 includes an aperture through which paddle 132 is slidably mounted on bar 130. In addition to moving up longitudinally along bar 130, paddle 132 can pivot, as shown in FIG. 4, about bar 130 allowing for operator access for removal of a stack from the corresponding bin 120.

Paddle 132 is spring loaded on bar 130 toward vertical transport system 122 and guide plate 140. The size of the spring 127 is important to proper operation of the stacker system. A spring that is suitable for handling stacks of large envelopes that may weigh as much as 25 pounds, would provide too much resistance during the stacking of small envelopes, the stack of which may be as little as 6 pounds. The converse is true for springs suitable for handling small stacks. In the preferred embodiment of the present invention, a nonlinear spring force from 8 ounces to 2 pounds can be used. For example, a commercially available spring reel can be used, such as ML-3949 manufactured by Ametek of Hatfield, Penn. Thus, the paddle 132 is biased toward the guide plate 140.

Figure 3:
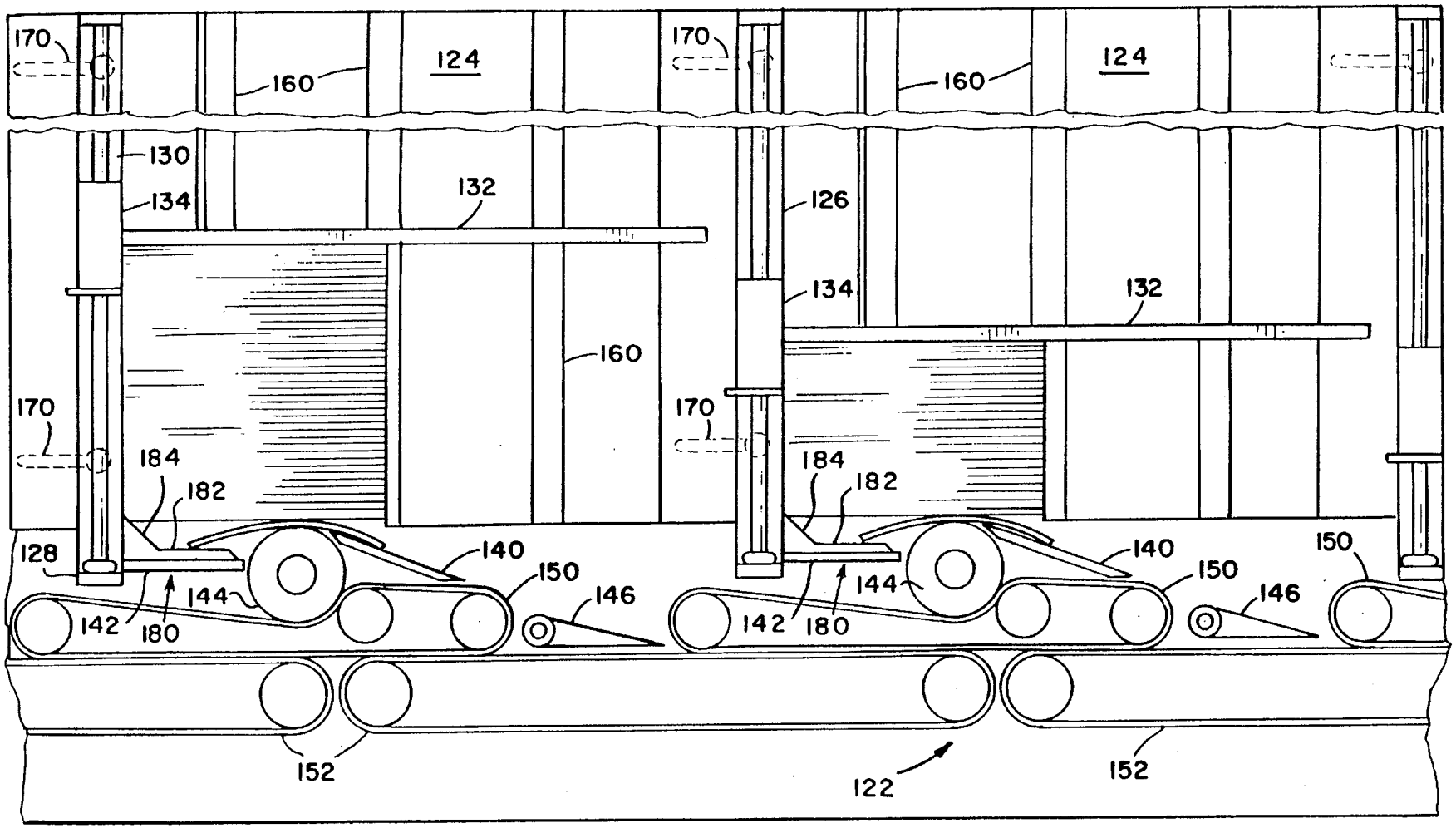
FIG. 3 is a top view of the stacking system in accordance with the present invention.
Figure 4:
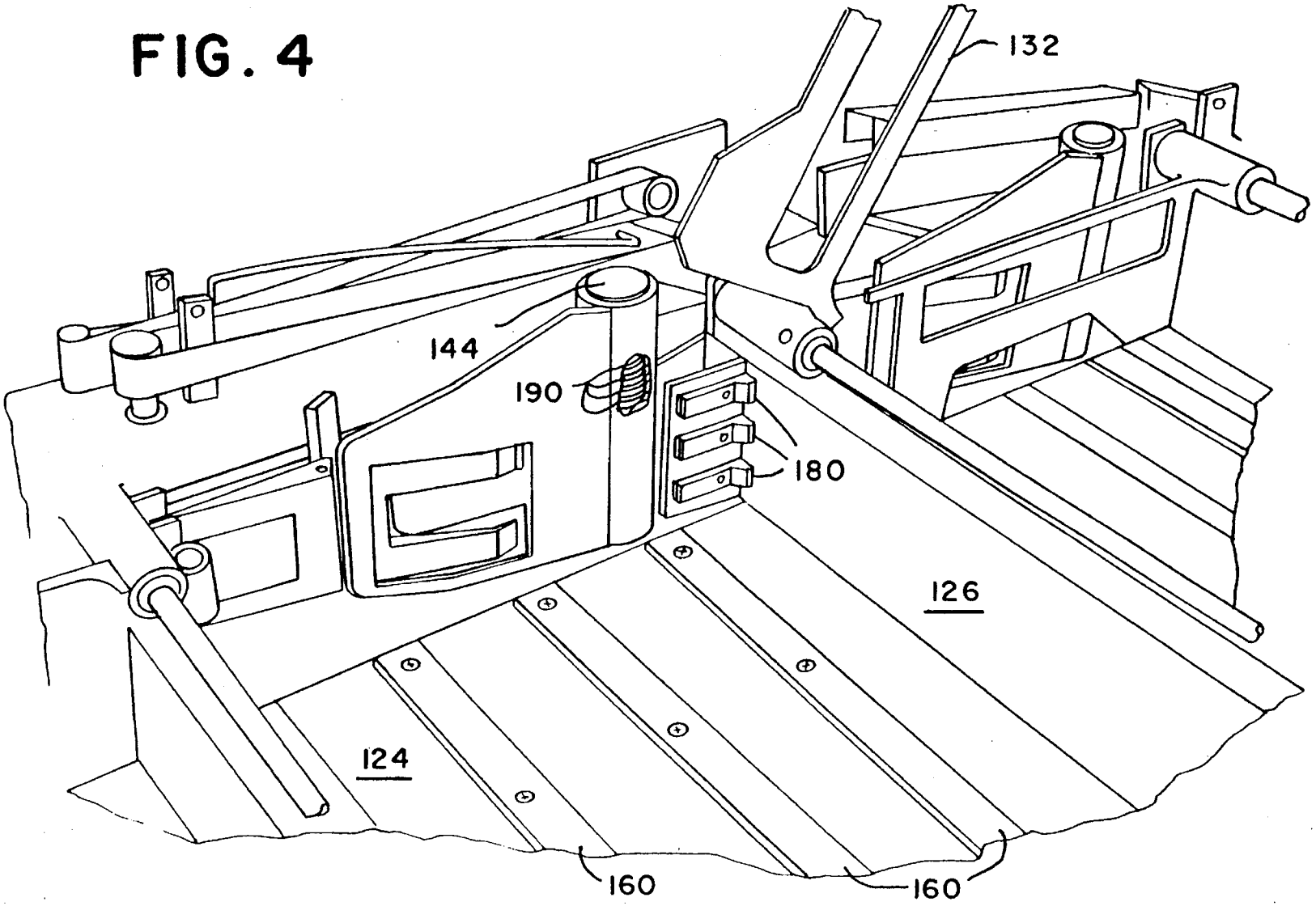
FIG. 4 is an enlarged perspective view of the stacking system showing an urge roller with a helical rib in accordance with the present invention.

Referring to FIGS. 3 and 4, vertical transport system 122 is a dual belt system comprising a plurality of inner belt sections 150 and outer belt sections 152. Inner and outer belt sections 150 and 152 include conventional drive and idler pulleys around which endless elastic belts are stretched. Gates 146 are located between inner belt sections 150, adjacent to the inner reach of outer belt sections 152 and extend parallel to the transport path of vertical transport system 122. Gates 146 pivot at one end about a vertical axis. Each of gates 146 include a rectangular pen section 145 in the non pivoting end through outer belt 152 travels when gate 146 pivots thereto. Outer belt section 152 is shown with multiple belts. In an alternate embodiment (not shown) a single outer belt transport is used in place of multiple outer belt sections 152. The single belt transport includes strategically placed idler pulleys which deflect the mail path to provide lateral force between the belts.

Low abrasive strips 160 are longitudinally fastened to the surface of base plate 124. It is important that strips 160 have a low coefficient of friction to allow the bottom edge of the envelopes to slide along the base plate 124. Thus, strips 160 act as the deck of bins 120. The strips 160 may be made from any suitable material such as Delrin AF, manufactured by DuPont of Wilmington, Del.

Each bin 120 further includes a lead-in guide plate 140 and a guide surface 142. An urge roller 144 is positioned between guide plate 140, guide surface 142 and transport belt 150. Each bin 120 also has a gate 146 which is actuated by a destinations signal from a control system (not shown) for stacker 110. Gate 146, when actuated, temporarily intersects transport 122 to thereby divert an envelope from the transport 122 toward the bin 120. The envelope feeds along guide plate 140 and enters the nip between urge roller 144 and the stack. The paddle 132 keeps the stack biased against the urge roller 144. In accordance with the present invention, the urge roller 144 includes a rib 190 wrapped around the surface of the urge roller 144 in a helical or screw thread pattern. Rotation of the urge roller 144 feeds the envelope until the lead edge registers on the registration wall 126 while the rib 190 drives the envelope downward until the bottom edge registers on strips 160.

A series of ramped shaped fingers 180 are horizontally mounted to guide surface 142. Fingers 180 include a flat section 182 that extends toward urge roller 144, and a ramped section 184 that extends towards registration wall 126. Flat section 182 is recessed from the outer most surface of urge roller 144 so as to sufficiently expose urge roller 144 during the entire urging of the envelope to registration wall 126. The fingers 180 may be made of any suitable material such as Delrin AF, manufactured by DuPont of Wilmington, Del.

With the structure having been disclosed, the operation of stacker 110 is set forth. As the envelope is transported on edge by vertical transport system 122, the control system for the stacker causes a gate 146 of a bin 120 to deflect momentarily toward the adjacent outer belt. This causes the envelope to deflect off gate 146 and follow guide plate 140. The lead edge of the envelope hits the previously stacked envelope (or paddle 132 if the bin is empty) and enters the nip between the stack and the urge roller 144. Due to the spring force of the paddle 132, the envelope is pressed tightly between the stack and the urge roller 144. As the urge roller 144 rotates the envelope is fed between guide surface 142 and the previously stacked envelope toward registration wall 126. As the envelope approaches registration wall 126, the envelope bends slightly and the lead edge of the envelope follows the recessed flat section 182 on fingers 180. When the lead edge contacts ramped section 184, it follows ramped section 184 until it stops against registration wall 126. Once an envelope stops against registration wall 126, a pocket is formed between the envelope and the flat section 182.

It will be understood that when envelopes are stacked in this manner there is a likelihood that the bottom edge of an envelope being stacked will lose contact with the strips 160. Envelope flutter, the declining angle of the base plate 124, bounce back from the envelope hitting the guide fingers 180 and registration wall 126, as well as other factors, all contribute to this problem. Thus, there is a likelihood that the envelope will be tightly held between the stack and the urge roller 144 by the paddle 132 without the bottom edge registered against the strips 160. As discussed above, this results in a poorly aligned stack and may even lead to jams.

In accordance with the present invention, the urge roller 144 is supplied with helical rib 190. The function of helical rib 190 is to drive the envelope downward so that the bottom edge registers against the strips 160. As the envelope initially enters the nip between the urge roller 144 and the stack, slippage occurs between the urge roller 144 and the envelope. The result is that the screw action of the rotating helical rib 190 drives the envelope downward as the urge roller 144 begins to feed the envelope toward registration wall 126. Additionally, after the lead edge of the envelope comes to rest against the registration wall 126, slippage again occurs. Thus, the screw action of the helical rib 190 continues to keep the envelope registered against the strips.

It should now be apparent that the urge roller 144 performs two functions. First, rotation of the urge roller 144 conventionally keeps the lead edge of the envelope against the registration wall 126 and the screw action of the helical rib 190 keeps the bottom edge of the envelope against the strips 160. The result is that the corners formed by the bottom edge and the lead edge of each envelope in the stack are perfectly aligned in two directions forming a neat stack of envelopes.

Figure 5A:
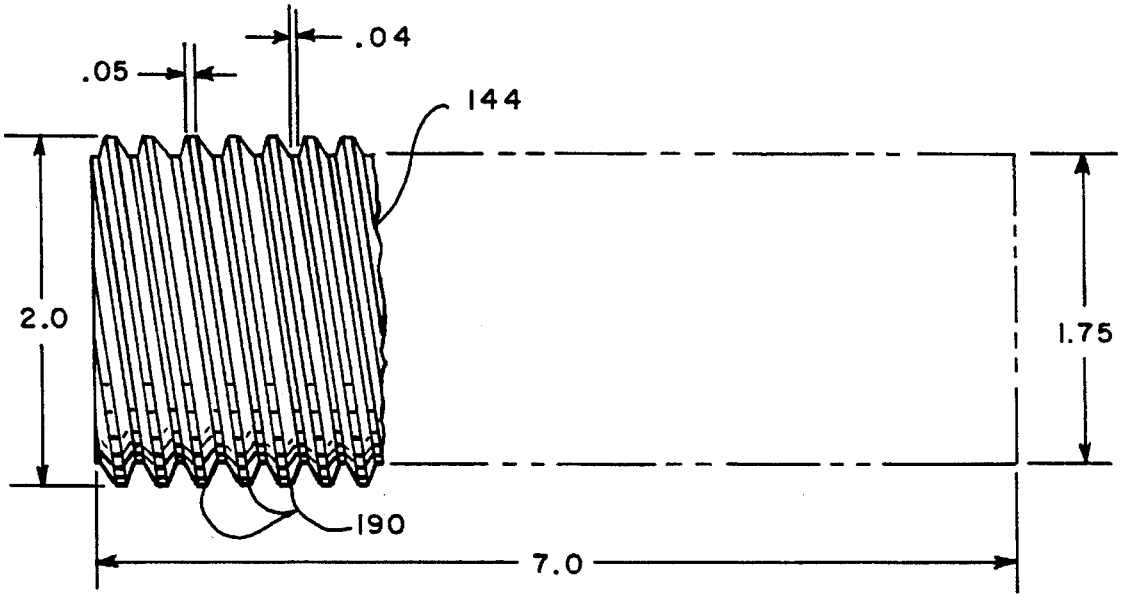
FIG. 5A includes a side view of the urge roller in accordance with the present invention.
Figure 5B:
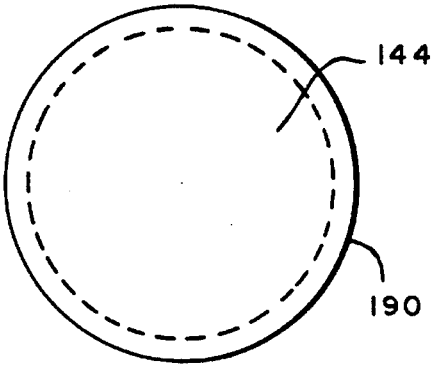
FIG. 5B includes an end view of the urge roller in accordance with the present invention.

Referring to FIGS. 5A and 5B, the urge roller 144 having helical rib 190 of the preferred embodiment is shown. Empirical testing has revealed the following approximate dimensions and specifications best suited for use in the preferred embodiment. An axial length of 7 inches. A major diameter of 2 inches and minor diameter of 1.75 inches yielding a rib height of 0.125 inches. A rib thickness of 0.125 inches. A helical pitch of 5 threads per inch. The rib profile is designed such that the top of the ribs 190 that contact the envelopes have a 0.05 inch flat while the root between the ribs 190 is 0.04 inches. Additionally, it is important that the urge roller is made from a suitable material such as urethane with a 90 durometer, commonly available from Mearthane Products Corporation of Cranston, R.I. under the trade name of MB-290. It will be understood by those skilled in the art that other rib patterns may be designed into urge roller 144 which would accomplish the same function.

While the present invention has been disclosed and described with reference to a single embodiment thereof, it will be apparent to those skilled in the art that variations and modifications may be made therein. It is also noted that the present invention is independent of the article being stacked and is not limited to stacking of envelopes, but may also have application where it is desired to stack other flat articles. It is, thus, intended in the following claims to cover each variation and modification that falls within the true spirit and scope of the present invention.

What is claimed is:

1. In an apparatus for stacking flat articles having a lead edge and a bottom edge, the apparatus including a deck surface, a vertical registration wall mounted on the deck surface, the vertical registration wall and the deck surface defining a stacking bin in which the articles are stacked, an urge roller for feeding the articles towards the registration wall, and a paddle slidably positioned in the stacking bin orthogonal to the registration wall and above the deck surface, the paddle biased toward the urge roller, and wherein the paddle moves away from the urge roller as the articles are stacked against the registration wall, an improvement to the urge roller comprising:

a rib extending outward from the urge roller so that as the urge roller rotates the rib contacts the article and feeds the article toward the deck surface.

2. The improvement of claim 1 wherein the rib simultaneously registers the lead edge of the article against the registration wall and the bottom edge of the article against the deck surface.

3. The improvement of claim 2 wherein the article is an envelope.

4. The improvement of claim 2 wherein the rib is arranged in a helical pattern.

5. The improvement of claim 4 wherein the article is an envelope.

* * * * *